US009124074B2

(12) United States Patent
Kuki et al.

(10) Patent No.: US 9,124,074 B2
(45) Date of Patent: Sep. 1, 2015

(54) SPARK PLUG REDUCING METAL SHELL TO IMPROVE FOULING RESISTANCE

(71) Applicant: NGK SPARK PLUG CO., LTD., Nogoya-shi,Aichi (JP)

(72) Inventors: Hiroaki Kuki, Nagoya (JP); Tomoaki Ueda, Nagoya (JP); Yuichi Yamada, Aichi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/419,680

(22) PCT Filed: Apr. 10, 2013

(86) PCT No.: PCT/JP2013/002425
§ 371 (c)(1),
(2) Date: Feb. 5, 2015

(87) PCT Pub. No.: WO2014/030273
PCT Pub. Date: Feb. 27, 2014

(65) Prior Publication Data

US 2015/0222095 A1 Aug. 6, 2015

(51) Int. Cl.
*H01T 13/20* (2006.01)

(52) U.S. Cl.
CPC ..... *H01T 13/20* (2013.01)

(58) Field of Classification Search
CPC ..... H01T 13/20; H01T 13/32; H01T 13/14
USPC ..... 123/169 R, 169 EL, 32, 41, 310; 313/118–145
See application file for complete search history.

(56) References Cited

U.S. PATENT DOCUMENTS

| | | | | |
|---|---|---|---|---|
| 6,091,185 | A | 7/2000 | Matsubara et al. | 313/138 |
| 7,250,711 | B2 * | 7/2007 | Koyama et al. | 313/141 |
| 7,554,253 | B2 * | 6/2009 | Koyama et al. | 313/141 |
| 2002/0140333 | A1 | 10/2002 | Kato et al. | 313/143 |

FOREIGN PATENT DOCUMENTS

| | | | | |
|---|---|---|---|---|
| JP | H10289777 | A | 10/1998 | H01T 13/20 |
| JP | 2006-236906 | A | 9/2006 | H01T 13/20 |
| JP | 2007-184299 | A | 7/2007 | H01T 13/32 |

OTHER PUBLICATIONS

International Search Report from corresponding International Patent Application No. PCT/JP2013/002425, dated May 21, 2013 (English-language translation provided).
"Road Vehicles—M12×1,25 spark-plugs with flat seating and 14mm bi-hexagon and their cylinder head housing" ISO 22977 International Standard, First edition, Jul. 15, 2005.
"Internal combustion engines—Spark-plugs" JIS B 8031, Japanese Industrial Standard, Dec. 20, 2006.

* cited by examiner

*Primary Examiner* — Tracie Y Green
(74) *Attorney, Agent, or Firm* — Kusner & Jaffe

(57) ABSTRACT

A spark plug includes an insulator and a metal shell arranged around the insulator and having a thread portion formed with a thread diameter of M12. The insulator has an engagement portion held on a step portion of the metal shell via a plate packing and a leg portion located to leave a clearance between the leg portion and an inner circumferential surface of the metal shell. Assuming that: L (mm) is a distance from a front end of the plate packing toward the front; and A (mm) is a size of the clearance, a site of the clearance where the size A becomes 0.5 mm or smaller is located at or rear of a position of 2.0 mm from the front end toward the front; and a relationship of $A \geq L \times 0.2 + 0.2$ (mm) is satisfied within a range of $3.0 \leq L \leq 4.0$.

4 Claims, 4 Drawing Sheets

SPARK PLUG REDUCING METAL SHELL TO IMPROVE FOULING RESISTANCE

FIELD OF THE INVENTION

The present invention relates to a spark plug for use in an internal combustion engine or the like.

BACKGROUND OF THE INVENTION

A spark plug is used in a combustion apparatus such as internal combustion engine (sometimes simply referred to as "engine") for ignition of an air-fuel mixture in a combustion chamber of the combustion apparatus. In general, the spark plug includes an insulator having an axial hole in an axis direction of the spark plug, a center electrode inserted in a front end side of the axial hole, a metal shell arranged around an outer circumferential surface of the insulator and a ground electrode joined to a front end portion of the metal shell so as to define a spark discharge gap between the center electrode and the ground electrode. A leg portion is formed on a front end side of the insulator such that an annular clearance is left between an outer circumferential surface of the leg portion and an inner circumferential surface of the metal shell. Further, a step portion and an engagement portion are formed on the inner circumferential surface of the metal shell and the outer circumferential surface of the insulator, respectively, such that the insulator is held in the metal shell by engagement of the engagement portion on the step portion via a metal plate packing (see, for example, Japanese Laid-Open Patent Publication No. H10-289777).

There is a possibility that carbon substance is generated by incomplete combustion of the air-fuel mixture in the combustion chamber and deposited on the surface of the leg portion. With the progress of such carbon deposition, the surface of the leg portion may be covered and fouled with the carbon deposit. In this case, the spark plug fails to cause a normal spark discharge in the spark discharge gap but can cause an air discharge between the insulator and the metal shell in the inner side of the clearance by the flow of electric current from the center electrode to the metal shell through the carbon deposit.

In recent years, the metal shell has been reduced in diameter for size reduction (diameter reduction) of the spark plug. However, the diameter reduction of the metal shell leads to a decrease in the size of the clearance between the inner circumferential surface of the metal shell and the outer circumferential surface of the leg portion in a direction perpendicular to the axis direction. As a result, the occurrence of an air discharge between the insulator and the metal shell due to the carbon deposit becomes of more concern.

It is conceivable to elongate the leg portion in order to achieve good fouling resistance even in the case where the metal shell is relatively small in diameter. In this technique, the entry of carbon substance into the inner side of the clearance, in which the occurrence of an air discharge is of particular concern, can be more assuredly prevented by the elongated leg portion for improvement in fouling resistance as the size of the clearance in the direction perpendicular to the axis direction is made relatively small.

When the leg portion is elongated, however, the front end part (leg portion) of the insulator is readily overheated during operation of the internal combustion engine or the like. It is thus likely that pre-ignition will occur by the action of the overheated front end part (leg portion) of the insulator as a heat source. As the front end part (leg portion) of the insulator has more tendency to be overheated with the recent improvement of engine output performance, the occurrence of pre-ignition becomes of more concern. For these reasons, it has been demanded to improve the fouling resistance of the spark plug without elongating the leg portion for prevention of overheating of the leg portion (i.e. for prevention of pre-ignition).

The present invention has been established in view of the above circumstances. An advantage of the present invention is a spark plug capable of achieving very good fouling resistance even when it is of particular concern that an air discharge occurs between an insulator and a metal shell by diameter reduction of the metal shell.

SUMMARY OF THE INVENTION

Hereinafter, configurations suitable for achieving the advantage of the present invention will be described below. Specific functions and effects of the respective aspects will also be described below as needed.

Configuration 1.

In accordance with a first aspect of the present invention, there is provided a spark plug, comprising:

a cylindrical insulator having an axial hole in an axis direction of the spark plug;

a center electrode inserted in a front end side of the axial hole; and a cylindrical metal shell arranged around an outer circumferential surface of the insulator, the metal shell having a thread portion formed on an outer circumferential surface thereof for mounting of the spark plug and a step portion formed on an inner circumferential surface thereof, the insulator having an engagement portion held on the step portion of the metal shell via an annular plate packing and a leg portion located front of the engagement portion with a clearance left between an outer circumferential surface of the leg portion and the inner circumferential surface of the metal shell, wherein the thread portion has a thread diameter of M12 or smaller; and wherein, assuming that: L (mm) is a distance from a front end of a contact region of the plate packing with the metal shell toward the front in the axis direction; and A (mm) is a size of the clearance in a direction perpendicular to the axis direction, when the clearance has a site where the size A becomes 0.5 mm or smaller, the site of the clearance where the size A becomes 0.5 mm or smaller is located at or rear of a position of 2 mm from the front end of the contact region of the plate packing with the metal shell toward the front in the axis direction, and the spark plug satisfies a relationship of $A \geq L \times 0.2 + 0.2$ (mm) within a range of $3.0 \leq L \leq 4.0$.

In order to efficiently transfer heat from the insulator to the metal shell and thereby more assuredly prevent overheating of the leg portion, it is preferable that the clearance has the site where the size A becomes 0.5 mm or smaller. It is more preferable that a length of the site of the clearance where the size A becomes 0.5 mm or smaller in the axis direction is set to a predetermined value (e.g. 0.5 mm) or larger.

Further, it is preferable that a length of the leg portion in the axis direction is set to a relatively small value (e.g. 14 mm or smaller) in order to more effectively prevent overheating of the leg portion.

Configuration 2.

In accordance with a second aspect of the present invention, there is provided a spark plug according to configuration 1, wherein, assuming that B (mm) is a thickness of the insulator in the direction perpendicular to the axis direction, the spark plug satisfies a relationship of $B \geq -0.2 \times L + 1.8$ (mm) within the range of $3.0 \leq L \leq 4.0$.

Configuration 3.

In accordance with a third aspect of the present invention, there is provided a spark plug according to configuration 1 or 2, wherein a radius difference between an inner radius of an innermost circumferential part of the step portion and an inner radius of an outermost circumferential part of the contact region of the step portion with the plate packing is 1.8 mm or larger.

In configuration 1, the thread portion of the metal shell has a thread diameter of M12 or smaller (that is, the metal shell is small in diameter). It is thus of concern that an air discharge occurs between the insulator and the metal shell by the deposition of carbon substance on the surface of the leg portion in the spark plug.

In view of such concern, the site of the clearance where the size A becomes 0.5 mm or smaller is located at or rear of the position of 2 mm from the front end of the contact region of the plate packing with the metal shell toward the front in the direction of the axis CL1 in configuration 1. At the site of the clearance where the size A becomes 0.5 mm or smaller, an air discharge is particularly likely to occur between the inner circumferential surface of the metal shell and the outer circumferential surface of the insulator by the deposition of carbon substance on the surface of the insulator. Even when there is the site of the clearance where the relationship of $A \leq 0.5$ mm is satisfied, this site is located in the innermost side of the clearance and is made sufficiently small in length in configuration 1. It is thus possible to assuredly prevent the occurrence of an air discharge between the metal shell and the insulator even in the case where some carbon substance is deposited on the leg portion. Accordingly, the spark plug is improved in fouling resistance.

Further, the relationship of $A \geq L \times 0.2 + 0.2$ (mm) is satisfied within the range of $3.0 \leq L \leq 4.0$ in configuration 1. Namely, the size of the clearance is set sufficiently large corresponding to the distance L within the range of $3.0 \leq L \leq 4.0$. It is thus possible to assuredly prevent the occurrence of an air discharge within the range of $3.0 \leq L \leq 4.0$. The combination of these structural features leads to dramatic improvement in fouling resistance.

The fouling resistance of the spark plug is improved by satisfaction of the relationship of $A \geq L \times 0.2 + 0.2$ (mm) within the range of $3.0 \leq L \leq 4.0$. However, the withstand voltage characteristics of the insulator are deteriorated when the thickness B of the insulator becomes excessively reduced for satisfaction of the above relationship. By such deterioration in withstand voltage characteristics, there arises a possibility of an abnormal discharge occurring between the center electrode and the metal shell through the insulator with the application of a voltage to the center electrode.

In view of such a problem, the relationship of $B \geq -0.2 \times L + 1.8$ (mm) is satisfied within the range of $3.0 \leq L \leq 4.0$ in configuration 2. As the thickness B of the insulator is set sufficiently large corresponding to the distance L, it is possible to provide the insulator with good withstand voltage characteristics and assuredly prevent the occurrence of an abnormal discharge through the insulator.

It is conceivable to increase the size A of the clearance by increasing the inner radius of the innermost circumferential part of the step portion. In such a case, however, the radius difference between the inner radius of the innermost circumferential part of the step portion and the inner radius of the outermost circumferential part of the contact region of the step portion with the plate packing become small and, by extension, the area of the contact region of the step portion with the plate packing becomes small. This can result in deterioration of gas tightness.

In view of such a problem, the radius difference is set to 1.8 mm or larger in configuration 3. As the area of the contact region of the step portion with the plate packing is made sufficiently large, it is possible to secure a sufficient contact area of the step portion and the plate packing and attain good gas tightness between the metal shell and the insulator.

DETAILED DESCRIPTION OF THE PREFERRED EMBODIMENTS

Figure 1:
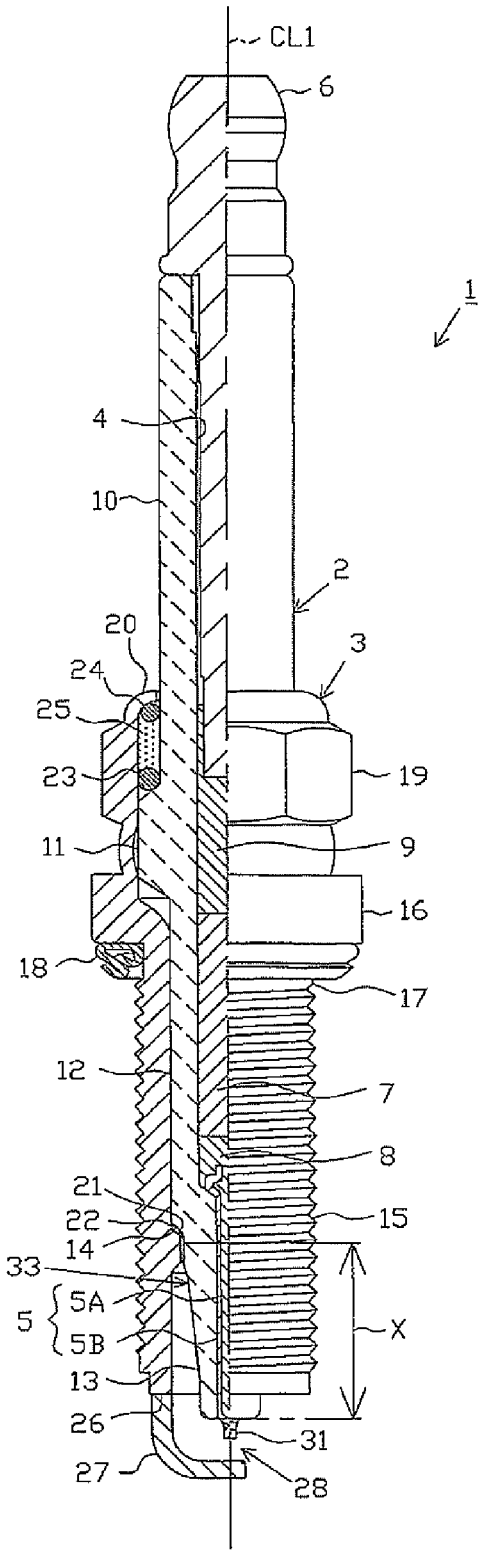
FIG. 1 is a partially cutaway elevation view of a spark plug according to one embodiment of the present invention.

Hereinafter, one embodiment of the present invention will be described below. FIG. 1 is a partially cutaway elevation view of a spark plug 1 according to one embodiment of the present invention. It is herein noted that the direction of an axis CL1 of the spark plug 1 corresponds to the vertical direction of FIG. 1 where the front and rear sides of the spark plug 1 are shown on the bottom and top sides of FIG. 1, respectively.

The spark plug 1 includes a ceramic insulator 2 as a cylindrical insulator and a cylindrical metal cell 3 holding therein the ceramic insulator 2.

The ceramic insulator 2 is made of sintered alumina as is generally known and has, as its outer shape, a rear body portion 10 located on a rear end side thereof, a large-diameter portion 11 located front of the rear body portion 10 and protruding radially outwardly, a middle body portion 12 located front of the large-diameter portion 11 and made smaller in diameter than the large-diameter portion 11 and a leg portion 13 located front of the middle body portion 12 and made smaller in diameter than the middle body portion 12. Herein, the large-diameter portion 11, the middle body portion 12 and major part of the leg portion 13 of the ceramic insulator 2 are accommodated in the metal shell 3. The ceramic insulator 2 also has an engagement portion 14 tapered toward the front at a location between the middle body portion 12 and the leg portion 13 such that the ceramic insulator 2 can be held in the metal shell 3 by means of the engagement portion 14. In the present embodiment, the length X of the leg portion 13 in the direction of the axis CL1 is set to a relatively small value (e.g. 14 mm or smaller) in order to prevent overheating of the front end part (leg portion 13) of the ceramic insulator 2 during operation of an internal combustion engine or the like.

An axial hole 4 is formed through the ceramic insulator 2 in the direction of the axis CL1. A center electrode 5 is inserted and fixed in a front end side of the axial hole 4. In the present embodiment, the center electrode 5 has an inner layer 5A made of high-thermal-conductivity metal material (such as copper, copper alloy or pure nickel (Ni)) and an outer layer 5B made of Ni-based alloy. The center electrode 5 is formed as a whole into a rod shape (cylindrical column shape) and retained in the ceramic insulator 2 with a front end portion of the center electrode 5 protruding from a front end of the ceramic insulator 2. For improvement in durability, a cylindrical column-shaped tip of high-wear-resistance metal (such as iridium alloy or platinum alloy) is joined to the front end portion of the center electrode 5 in the present embodiment.

A terminal electrode 6 is inserted and fixed in a rear end side of the axial hole 4 with a rear end portion of the terminal electrode 6 protruding from a rear end of the ceramic insulator 2.

A cylindrical column-shaped resistive element 7 is disposed between the center electrode 5 and the terminal electrode 6 within the axial hole 4 and is electrically connected at opposite ends thereof to the center electrode 5 and the terminal electrode 6 via conductive glass seal layers 8 and 9, respectively.

The metal shell 3 is made of metal such as low carbon steel (e.g. S25C) in a cylindrical shape and has, on an outer circumferential surface thereof, a thread portion (male thread portion) 15 adapted for mounting the spark plug 1 onto a combustion apparatus such as internal combustion engine or fuel cell processing device and a seat portion 16 located rear of the thread portion 15 and protruding radially outwardly. A ring-shaped gasket 18 is fitted around a thread neck 17 on a rear end of the thread portion 15. The metal shell 3 also has, on a rear end side thereof, a tool engagement portion 19 formed into a hexagonal cross section so as to engage with a tool such as wrench for mounting the spark plug 1 onto the combustion apparatus as well as a crimp portion 20 bent radially inwardly at a rear end of the metal shell 3. In the present embodiment, the metal shell 3 is made smaller in diameter such that the thread portion 15 has a thread diameter of M12 or smaller for size reduction (diameter reduction) of the spark plug 1.

The metal shell 3 has, on an inner circumferential surface thereof, a step portion 21 tapered down and gradually decreasing in diameter toward the front so as to hold thereon the ceramic insulator 2. The ceramic insulator 2 is inserted in the metal shell 3 from the rear toward the front and then fixed in the metal shell 3 by crimping an open rear end portion of the metal shell 3 radially inwardly, with the engagement portion 14 of the ceramic insulator 2 engaged on the step portion 21 of the metal shell 3 via an annular plate packing 22, and thereby forming the crimp portion 20. The plate packing 22 is held between the engagement portion 14 and the step portion 21 so as to maintain the gas tightness of a combustion chamber of the combustion apparatus and prevent fuel gas from leaking to the outside through a clearance space between the leg portion 13 of the ceramic insulator 2, which is exposed to the combustion chamber, and the inner circumferential surface of the metal shell 3. Further, the inner diameter of part of the metal shell 3 located front of the step portion 21 is made uniform along the direction of the axis CL1.

In order to secure more complete seal by crimping, annular ring members 23 and 24 are disposed between the metal shell 3 and the ceramic insulator 2 within the rear end portion of the metal shell 3; and the space between the ring members 23 and 34 is filled with a powder of talc 25. In other words, the metal shell 3 holds therein the ceramic insulator 2 via the plate packing 22, the ring members 23 and 24 and the talc 25.

A ground electrode 27 is joined to a front end portion 26 of the metal shell 3 and bent at a middle portion thereof such that a distal end portion of the ground electrode 27 faces the front end portion of the center electrode 5. There is thus defined a spark discharge gap 28 between the front end portion of the center electrode 5 (tip 31) and the distal end portion of the ground electrode 27. In this spark discharge gap 28, a spark discharge is caused substantially along the direction of the axis CL1.

Figure 2:
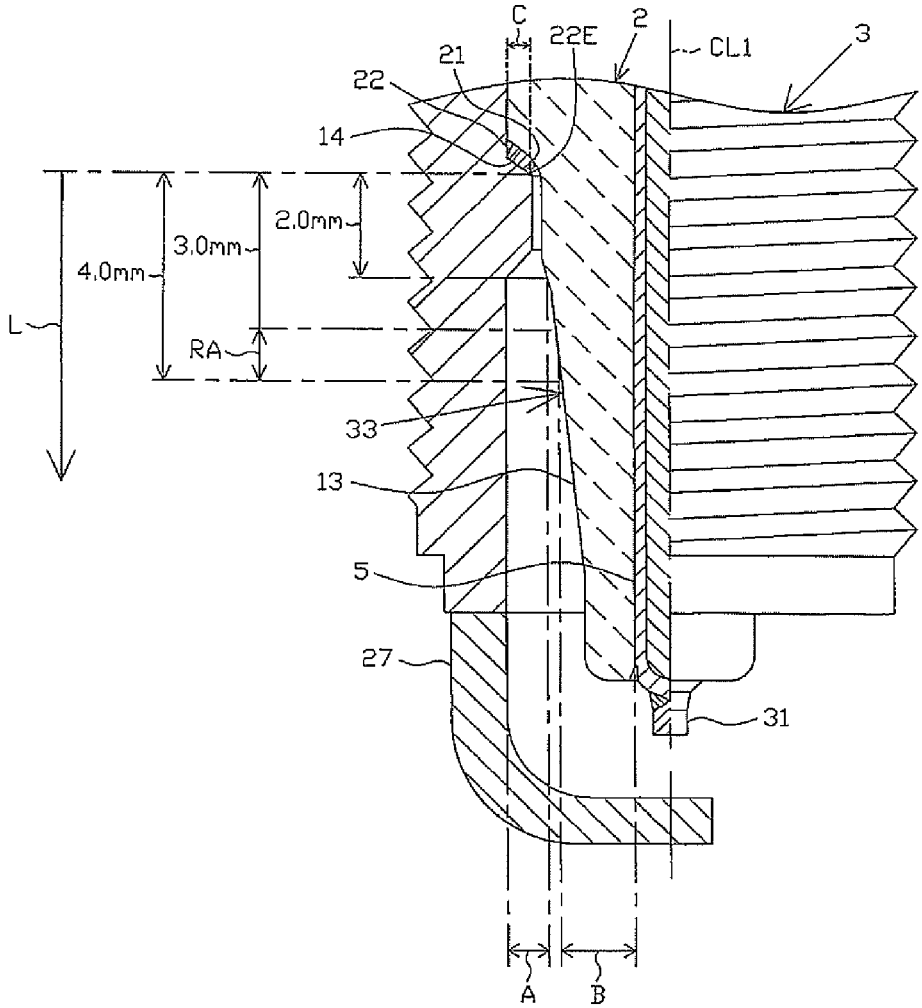
FIG. 2 is a partially cutaway elevation view showing the size A of a clearance etc. in the spark plug according to the one embodiment of the present invention.

In the present embodiment, an annular clearance 33 is left between the outer circumferential surface of the leg portion 13 and the inner circumferential surface of the metal shell 3 as shown in FIG. 2. It is herein assumed that: L (mm) is a distance from a front end 22E of a contact region of the plate packing 22 with the metal shell 3 (step portion 21) toward the front in the direction of the axis CL1; and A (mm) is a size of the clearance 33 in a direction perpendicular to the direction of the axis CL1. The spark plug 1 is so configured that the size A of the clearance 33 is at least larger than 0.5 mm on a front side with respect to a position of 2 mm from the front end 22E of the contact region of the plate packing 22 with the metal shell 3 toward the front in the direction of the axis CL1 (i.e. the spark plug 1 is so configured as to satisfy the relationship of $A>0.5$ within the range of $L>2.0$). At a site of the clearance 33 where the size A becomes 0.5 mm or smaller, an air discharge is particularly likely to occur between the inner circumferential surface of the metal shell 3 and the outer circumferential surface of the ceramic insulator 2 by the deposition of carbon substance on the leg portion 13. In the present embodiment, the site of the clearance 33 where the relationship of $A\leq0.5$ mm can be satisfied is located at or rear of the position of 2 mm from the front end 22E of the contact region of the plate packing 22 with the metal shell 3 toward the front in the direction of the axis CL1. Even when there is the site of the clearance 33 where the relationship of $A\leq0.5$ mm is satisfied, this site is located in the innermost side of the clearance and is made sufficiently small in length.

In the present embodiment, the site where the size A is 0.5 mm or smaller is provided in at least part of the clearance 33 located at or rear of the position of 2 mm from the front end 22E toward the front; and the length of the site of the clearance 33 where the size A is 0.5 mm or smaller in the direction of the axis CL1 is set to a predetermined value (e.g. 0.5 mm) or larger. In such a configuration, heat of the leg portion 13 and heat of the center electrode 5 are efficiently transferred to the metal shell 3 from through the ceramic insulator 2 even though the front end part of the leg portion 13 protrudes from the front end of the metal shell 3 and tends to reach a high temperature during operation of the internal combustion engine or the like and even though the front end portion of the center electrode 5 (tip 31) protrudes from the front end of the ceramic insulator 5. This makes it possible to effectively prevent overheating of the leg portion 13 and the center electrode 5.

The spark plug 1 is also so configured to satisfy the relationship of $A\geq L\times0.2+0.2$ (mm) within the range RA of $3.0\leq L\leq4.0$ (i.e. within the front side range with respect to the position of 2.0 mm from the front end 22E toward the front, in which the occurrence of an air discharge is of particular concern).

In the present embodiment, the outer circumferential surface of part of the leg portion 13 located between the position of 2.0 mm from the front end 22E toward the front and the position of 4.0 mm from the front end 22E toward the front is decreased in diameter at a given rate. Namely, the outline of the leg portion 13 is made straight within the range of $2.0\leq L\leq4.0$ when taken in cross section along the axis CL1.

Furthermore, the spark plug 1 is so configured as to satisfy the relationship of $B\geq-0.2\times L+1.8$ (mm) within the range of $3.0\leq L\leq4.0$ assuming that B (mm) is a thickness of the ceramic insulator 2 in the direction perpendicular to the direction of the axis CL1. By satisfaction of the relationship of $A \geq L \times 0.2 + 0.2$ (mm) within the range of $3.0 \leq L \leq 4.0$, it is possible to set the size A of the clearance 33 to be sufficiently large and prevent the occurrence of an air discharge. On the other hand, it is possible to secure the sufficient thickness B of the ceramic insulator 2 and impart good voltage resistance to the ceramic insulator 2 by satisfaction of the relationship of $B \geq -0.2 \times L + 1.8$ (mm) within the range of $3.0 \leq L \leq 4.0$.

In addition, the radius difference C between the inner radius of the innermost circumferential part of the step portion 21 and the inner radius of the outermost circumferential part of the contact region of the step portion 21 with the plate packing 22 is set to 1.8 mm or larger so as to secure a sufficiently large area of contact between the step portion 21 and the plate packing 22.

As described above, the site of the clearance 33 where the size A becomes 0.5 mm or smaller is located at or rear of the position of 2 mm from the front end 22E of the contact region of the plate packing 22 with the metal shell 3 toward the front in the direction of the axis CL1 in the present embodiment. That is, the site of the clearance 33 where the relationship of $A \leq 0.5$ mm is satisfied is located in the innermost side of the clearance and is made sufficiently small in length. It is thus possible to assuredly prevent the occurrence of an air discharge between the metal shell 2 and the ceramic insulator 3 even in the case where some carbon substance is deposited on the leg portion 13. Accordingly, the spark plug 1 is improved in fouling resistance.

Further, the relationship of $A \geq L \times 0.2 + 0.2$ (mm) is satisfied within the range of $3.0 \leq L \leq 4.0$ in the present embodiment. Namely, the size of the clearance 33 is set sufficiently large corresponding to the distance L within the range of $3.0 \leq L \leq 4.0$. It is thus possible to assuredly prevent the occurrence of an air discharge within the range of $3.0 \leq L \leq 4.0$. The combination of the above structural features leads to dramatic improvement in fouling resistance.

Furthermore, the relationship of $B \geq -0.2 \times L + 1.8$ (mm) is satisfied within the range of $3.0 \leq L \leq 4.0$. As the thickness B of the ceramic insulator 2 is set sufficiently large corresponding to the distance L, it is possible to provide the ceramic insulator 2 with good withstand voltage characteristics and assuredly prevent the occurrence of an abnormal discharge through the ceramic insulator 2.

In addition, the radius difference C is set to 1.8 mm or larger. As the area of the contact region of the step portion 21 with the plate packing 22 is made sufficiently large, it is possible to secure a sufficient contact area of the step portion 21 and the plate packing 22 and attain good gas tightness between the ceramic insulator 2 and the metal shell 3.

In order to verify the effects of the above embodiment, spark plug samples were each prepared by forming a clearance with a size A of 0.5 mm or smaller within the range of $0.0 \leq L \leq 3.0$ starting from the front end of the contact region of the plate packing with the metal shell and varying the length of the clearance in the axis direction (corresponding to the distance L). Each of the samples was tested by fouling resistance evaluation test according to JIS D1606.

The fouling resistance evaluation test was conducted as follows. A test vehicle with a 1.3-L, 4-cylinder, naturally-aspirated MPI engine was placed on a chassis dynamometer in a low-temperature test room (−10° C.). Each of the samples was fixed to the engine of the test vehicle. After the engine was subjected to idling three times, the test vehicle was driven in third gear at 35 km/h for 40 seconds. The engine was subjected to idling for 90 seconds. The test vehicle was subsequently driven in third gear at 35 km/h for 40 seconds. Then, the engine was once stopped and cooled down. After the engine was subjected to idling three times, the vehicle was driven in first gear at 15 km/h for 20 seconds. This driving operation was repeated three times while stopping the engine for 30 seconds after each driving operation. After that, the engine was stopped. Assuming the above series of test pattern procedure as 1 cycle, the insulation resistance between the center electrode and the metal shell of the sample was measured every cycle to determine the number of cycles by which the insulation resistance became 10 MΩ or lower. The fouling resistance of the sample was evaluated as inadequate and marked with the symbol "x" when the number of cycles by which the insulation resistance became 10 MΩ or lower (referred to as "10-MΩ cycle number") was 5 or less. On the other hand, the fouling resistance of the sample was evaluated as good and marked with the symbol "○" when the 10-MΩ cycle number was 6 or more. The fouling resistance evaluation test results are shown in TABLE 1.

In each sample, the thread diameter of the thread potion was set to M12; the opposite side dimension of the tool engagement portion was set to 14 mm; the distance from the front end of the metal shell to the center of the spark discharge gap along the axis was set to 3.5 mm; and the size of the spark discharge gap was set to 1.0 mm. Further, a tip of iridium alloy was joined to the front end portion of the center electrode in each sample; and all of the samples were of the same heat value (heat value 7) (the same applies to the following).

The size A of the clearance was set to 0.75 mm at a position of L=3.0 mm and set to 0.90 mm at a position of L=4.0 mm. (In other words, the relationship of $A \geq L \times 0.2 + 0.2$ (mm) was not satisfied within the range of $3.0 \leq L \leq 4.0$.)

TABLE 1

| Length (mm) of clearance where A ≤0.5 mm | 0.5 | 1.0 | 1.5 | 2.0 | 2.5 | 3.0 |
|---|---|---|---|---|---|---|
| 10-MΩ cycle number | 8 | 8 | 8 | 7 | 5 | 5 |
| Evaluation result | ○ | ○ | ○ | ○ | x | x |

As shown in TABLE 1, the samples in which the clearance had a size A of 0.5 mm or smaller and a length of 2.0 mm or smaller, i.e., in which the site of the clearance where the size A became 0.5 mm or smaller was located at or rear of the position of 2 mm from the front end of the contact region of the plate packing with the metal shell toward the front in the axis direction showed good fouling resistance. The reason for this is assumed that the site of the clearance where the size A was 0.5 mm or smaller, in which the occurrence of air discharge due to carbon deposition was of particular concern, was located in the innermost side of the clearance and made sufficiently small in length.

Next, spark plug samples were prepared by varying the size A of the clearance at a position of L=3.0 mm and the size A of the clearance at a position of L=4.0 mm. Each of the samples was by fouling resistance evaluation test in the same manner as above. The fouling resistance evaluation test results are shown in TABLES 2 and 3.

In each sample, the site of the clearance where the size A was 0.5 mm or smaller was located in the innermost side of the clearance; and the length of the site of the clearance where the size A was 0.5 mm or smaller was set to 2.0 mm. Further, the outer circumferential surface of the leg portion was decreased in diameter at a given rate toward the front in the axis direction within the range of $3.0 \leq L \leq 4.0$ so that the leg portion had a straight outline when taken in cross section along the axis (the same applies to the following).

TABLE 2

| L (mm) | No. | 1 | 2 | 3 | 4 | 5 | 6 | 7 |
|---|---|---|---|---|---|---|---|---|
| 3.0 (L × 0.2 + 0.2 = 0.80) | Size A (mm) | 0.75 | 0.80 | 0.85 | 0.75 | 0.75 | 0.75 | 0.75 |
| 4.0 (L × 0.2 + 0.2 = 1.00) | | 0.90 | 0.90 | 0.90 | 0.95 | 1.00 | 1.05 | 1.10 |
| 10-MΩ cycle number | | 7 | 8 | 8 | 7 | 8 | 8 | 8 |
| Evaluation result | | ○ | ○ | ○ | ○ | ○ | ○ | ○ |

TABLE 3

| L (mm) | No. | 8 | 9 | 10 | 11 | 12 | 13 |
|---|---|---|---|---|---|---|---|
| 3.0 (L x 0.2 + 0.2 = 0.80) | Size A (mm) | 0.80 | 0.90 | 1.00 | 1.10 | 1.20 | 1.30 |
| 4.0 (L x 0.2 + 0.2 = 1.00) | | 1.00 | 1.10 | 1.20 | 1.30 | 1.40 | 1.05 |
| 10-MS2 cycle number | | 9 | 9 | 9 | 9 | 10 | 10 |
| Evaluation result | | ◎ | ◎ | ◎ | ◎ | ◎ | ◎ |

As shown in TABLES 2 and 3, all of the samples showed good fouling resistance. Among others, the samples (sample Nos. 8 to 13) in which the relationship of A≥L×0.2+0.2 (mm) was satisfied within the range of 3.0≤L≤4.0 showed very good fouling resistance. The reason for this is assumed that the size of the clearance was set sufficiently large corresponding to the distance L within the range of 3.0≤L≤4.0 in which the occurrence of an air discharge due to fouling was of particular concern.

It has been shown by the above test results that it is preferable to locate the site of the clearance where the size A becomes 0.5 mm or smaller at or rear of the position of 2.0 mm from the front end of the contact region of the plate packing with the metal shell toward the front in the direction of the axis CL1 and, at the same time, satisfy the relationship of A≥L×0.2+0.2 (mm) within the range of 3.0≤L≤4.0 for the purpose of dramatic improvement in fouling resistance.

Further, spark plug samples were prepared by varying the thickness B of the ceramic insulator at a position of L=3.0 mm and the thickness B of the ceramic insulator at a position of L=4.0 mm. Each of the samples was tested by withstand voltage evaluation test according to JIS B8031. The withstand voltage evaluation test was conducted as follows. Each of the samples was fixed in a predetermined chamber after the ground electrode was removed from the sample. The inside of the chamber was set to a given high pressure. In this state, the voltage (withstand voltage) at which a discharge occurred between the center electrode and the metal shell through the ceramic insulator was measured with the application of a voltage to the center electrode. The withstand voltage characteristics of the sample was evaluated as inadequate and marked with the symbol "x" when the withstand voltage was lower than 25 kV. The withstand voltage characteristics of the sample was evaluated as rather poor and marked with the symbol "Δ" when the withstand voltage was higher than or equal to 25 kV and lower than 30 kV. The withstand voltage characteristics of the sample was evaluated as good and marked with the symbol "○" when the withstand voltage was higher than or equal to 30 kV and lower than 35 kV. The withstand voltage characteristics of the sample was evaluated as very good and marked with the symbol "◎" when the withstand voltage was higher than or equal to 35 kV.

The withstand voltage evaluation test results are shown in TABLES 4 and 5. In each sample, the relationship of A≥L×0.2+0.2 was satisfied within the range of 3.0≤L≤4.0. For reference purposes, the size A of the clearance at L=3.0 mm and the size A of the clearance at L=4.0 mm are indicated for each sample in TABLES 4 and 5.

TABLE 4

| L (mm) | No. | 21 | 22 | 23 | 24 |
|---|---|---|---|---|---|
| 3.0 (−0.2 × L + 1.8 = 1.20) | Thickness B (mm) | 1.55 (A = 0.75 mm) | 1.50 (A = 0.80 mm) | 1.40 (A = 0.90 mm) | 1.30 (A = 1.00 mm) |
| 4.0 (−0.2 × L + 1.8 = 1.00) | | 1.40 (A = 0.90 mm) | 1.30 (A = 1.00 mm) | 1.20 (A = 1.10 mm) | 1.10 (A = 1.20 mm) |
| Withstand voltage (kV) | | 35 | 35 | 33 | 31 |
| Evaluation result | | ◎ | ◎ | ○ | ○ |

TABLE 5

| L (mm) | No. | 25 | 26 | 27 |
|---|---|---|---|---|
| 3.0 (−0.2 × L + 1.8 = 1.20) | Thickness B (mm) | 1.20 (A = 1.10 mm) | 1.10 (A = 1.20 mm) | 1.00 (A = 1.30 mm) |
| 4.0 (−0.2 × L + 1.8 = 1.00) | | 1.00 (A = 1.30 mm) | 0.90 (A = 1.40 mm) | 0.80 (A = 1.50 mm) |
| Withstand voltage (kV) | | 30 | 28 | 27 |
| Evaluation result | | ○ | Δ | Δ |

As shown in TABLES 4 and 5, the samples (samples Nos. 21 to 25) in which the relationship of B≥−0.2×L+1.8 (mm) was satisfied within the range of 3.0≤L≤4.0 had a withstand voltage of 30 kV or higher and showed good withstand voltage characteristics. The reason for this is assumed that the thickness B of the ceramic insulator was set sufficiently large within the range of 3.0≤L≤4.0.

It has been shown by the above test results that it is preferable to satisfy the relationship of B≥−0.2×L+1.8 (mm) within the range of 3.0≤L≤4.0 for the purpose of more assuredly preventing deterioration of the withstand voltage characteristics of the ceramic insulator caused due to increase in the size A of the clearance within the range of 3.0≤L≤4.0.

Next, spark plug samples were prepared by varying the radius difference C between the inner radius of the innermost circumferential part of the step portion and the inner radius of the outermost circumferential part of the contact region of the step portion with the plate packing. Each of the samples was tested by gas tightness evaluation test according to ISO 11565. The gas tightness evaluation test was conducted as follows. Each of the samples was fixed in a predetermined chamber. After the sample was heated to 200° C., an air pressure of 2.0 MPa was applied to a front end part of the sample. In this state, the amount of air leakage from between the ceramic insulator and the metal shell was measured. The gas tightness of the sample was evaluated as poor and marked with the symbol "x" when the air leakage amount was 2 mL/min or more. The gas tightness of the sample was evaluated as rather poor and marked with the symbol "Δ" when the air leakage amount was 1 mL/min or more and less than 2 mL/min. The gas tightness of the sample was evaluated as good and marked with the symbol "○" when the air leakage amount was less than 1 mL/min. The gas tightness evaluation test results are shown in TABLE 6. In ISO 11565, the gas tightness is evaluated as good when the air leakage amount is less than 2 mL/min. In other words, the gas tightness of each sample was evaluated on more rigorous criteria in this evaluation test than in ISO.

TABLE 6

| Radius difference C (mm) | 1.2 | 1.4 | 1.6 | 1.8 | 2.0 | 2.2 |
|---|---|---|---|---|---|---|
| Evaluation result | Δ | Δ | Δ | ○ | ○ | ○ |

As shown in TABLE 6, the samples in which the radius difference C was set to 1.8 mm or larger showed good gas tightness. The reason for this is assumed that the area of the contact region of the step portion with the plate packing was set sufficiently large so as to secure a sufficient contact area of the step portion and the plate packing.

It has been shown by the above test results that it is preferable to set the radius difference between the inner radius of the innermost circumferential part of the step portion and the inner radius of the outermost circumferential part of the contact region of the step portion with the plate packing to be 1.8 mm or larger for the purpose of securing good gas tightness.

Although the present invention has been described above with reference to the specific exemplary embodiment, the present invention is not limited to the above exemplary embodiment. For example, the present invention can alternatively be embodied as described below. It is needless to say that any application examples modifications other than the following examples are possible.

Figure 3:
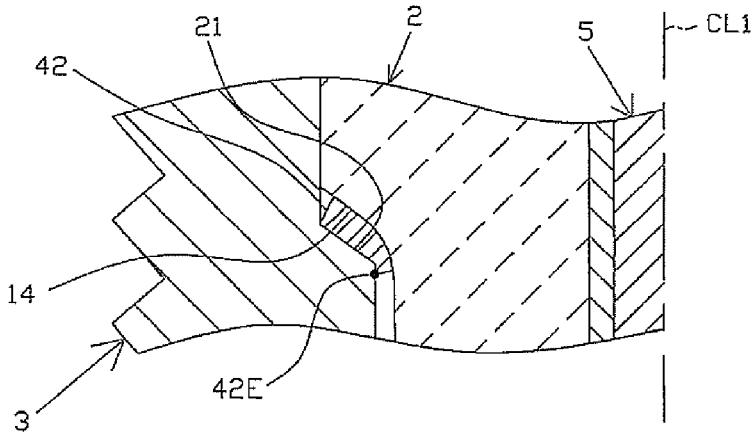
FIG. 3 is a partially cutaway elevation view showing the structure of a plate packing in a spark plug according to another embodiment of the present invention.

(a) In the above embodiment, the front end 22E of the contact region of the plate packing 22 with the metal shell 33 is located on the step portion 21. However, the front end 22E of the contact region of the plate packing 22 with the metal shell 33 is not necessarily located on the step portion 21. For example, it is feasible to provide a plate packing 42 such that a front end 42E of a contact region of the plate packing 42 with the metal shell 33 is located front of the step portion 21 as shown in FIG. 3.

Figure 4:
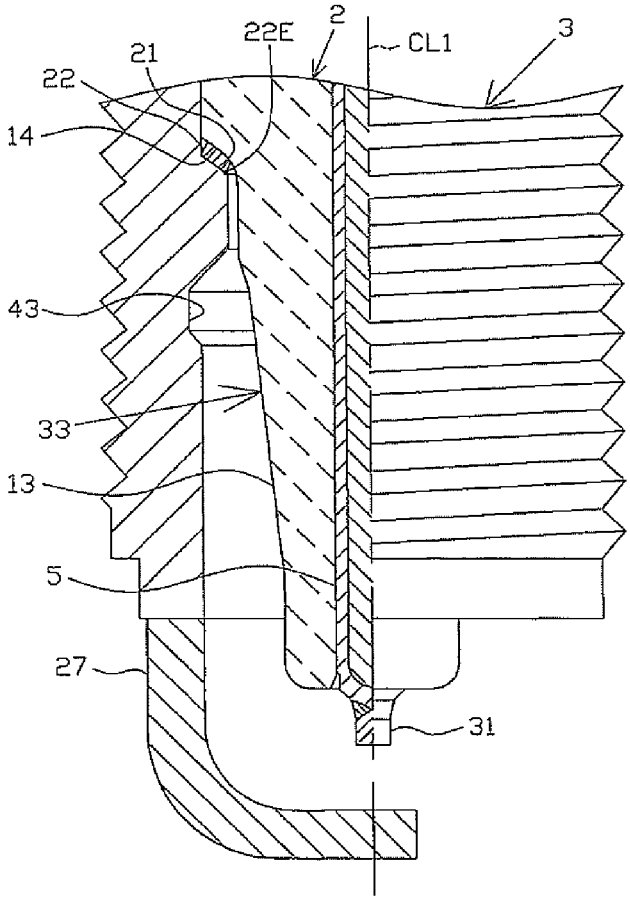
FIG. 4 is a partially cutaway elevation view showing the structure of a metal shell in a spark plug according to still another embodiment of the present invention.
Figure 5:
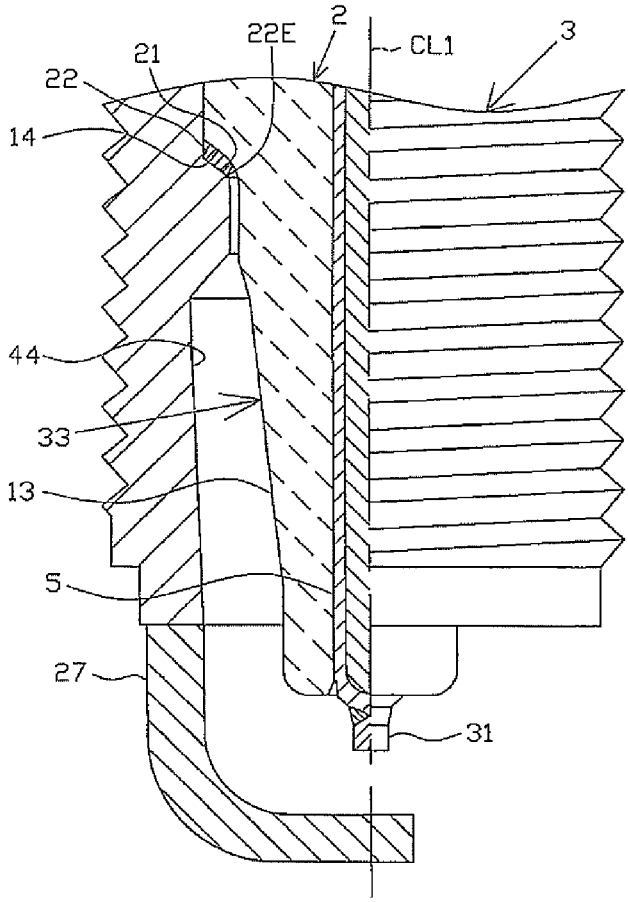
FIG. 5 is a partially cutaway elevation view showing the structure of a metal shell in a spark plug according to yet another embodiment of the present invention.

(b) Although the part of the metal shell 3 located front of the step portion 21 is made constant in inner diameter in the direction of the axis CL1 in the above embodiment, it is alternatively feasible to provide an annular groove portion 43 in the inner circumference of the part of the metal shell 3 located front of the step portion 21 as shown in FIG. 4. Further, it is alternatively feasible that the part of the metal shell 3 located front of the step portion 21 has an inner circumferential surface 44 gradually increasing in diameter toward the rear as shown in FIG. 5. In these cases, the size A of the clearance 33 is more assuredly increased in the inner side of the clearance 33. This makes it possible that the site of the clearance 33 where the size A becomes 0.5 mm or smaller can be more assuredly located at or rear of the position of 2 mm from the front end 22E toward the front in the direction of the axis CL2. This also makes it easier that the spark plug can satisfy the relationship of $A \geq L \times 0.2 + 0.2$ (mm) within the range of $3.0 \leq L \leq 4.0$. As there occurs no change in the thickness B of the ceramic insulator 2, the spark plug can easily satisfy the relationship of $B \geq -0.2 \times L + 1.8$ (mm) within the range of $3.0 \leq L \leq 4.0$.

(c) In the above embodiment, the ground electrode 27 is joined to the front end portion 26 of the metal shell 3. It is alternatively feasible to form the ground electrode by cutting a part of the metal shell (or a part of a front-end metal member previously joined to the metal shell) (see, for example, Japanese Laid-Open Patent Publication No. 2006-236906).

(d) Although the tool engagement portion 19 is hexagonal in cross section in the above embodiment, the shape of the tool engagement portion 19 is not however limited to such a hexagonal cross-section shape. The tool engagement portion 19 may alternatively be formed into a Bi-HEX shape (modified dodecagonal shape) (according to ISO 22977: 2005(E)) or the like.

DESCRIPTION OF REFERENCE NUMERALS

1: Spark plug
2: Ceramic insulator (Insulator)
3: Metal shell
4: Axial hole
5: Center electrode
13: Leg portion
14: Engagement portion
15: Thread portion
21: Step portion
22: Plate packing
33: Clearance
CL1: Axis

The invention claimed is:

1. A spark plug, comprising:

a cylindrical insulator having an axial hole in an axis direction of the spark plug;

a center electrode inserted in a front end side of the axial hole; and a cylindrical metal shell arranged around an outer circumferential surface of the insulator, the metal shell having a thread portion formed on an outer circumferential surface thereof for mounting of the spark plug and a step portion formed on an inner circumferential surface thereof, the insulator having an engagement portion held on the step portion of the metal shell via an annular plate packing and a leg portion located front of the engagement portion with a clearance left between an outer circumferential surface of the leg portion and the inner circumferential surface of the metal shell, wherein the thread portion has a thread diameter of M12 or smaller; and wherein, assuming that: L (mm) is a distance from a front end of a contact region of the plate packing with the metal shell toward the front in the axis direction; and A (mm) is a size of the clearance in a direction perpendicular to the axis direction, when the clearance has a site where the size A becomes 0.5 mm or smaller, the site of the clearance where the size A becomes 0.5 mm or smaller is located at or rear of a position of 2 mm from the front end of the contact region of the plate packing with the metal shell toward the front in the axis direction, and the spark plug satisfies a relationship of $A \geq L \times 0.2 + 0.2$ (mm) within a range of $3.0 \leq L \leq 4.0$.

2. The spark plug according to claim 1, wherein, assuming that B (mm) is a thickness of the insulator in the direction perpendicular to the axis direction, the spark plug satisfies a relationship of $B \geq -0.2 \times L + 1.8$ (mm) within the range of $3.0 \leq L \leq 4.0$.

3. The spark plug according to claim 1, wherein a radius difference between an inner radius of an innermost circumferential part of the step portion and an inner radius of an outermost circumferential part of the contact region of the step portion with the plate packing is 1.8 mm or larger.

4. The spark plug according to claim 2, wherein a radius difference between an inner radius of an innermost circumferential part of the step portion and an inner radius of an outermost circumferential part of the contact region of the step portion with the plate packing is 1.8 mm or larger.

* * * * *

UNITED STATES PATENT AND TRADEMARK OFFICE

CERTIFICATE OF CORRECTION

PATENT NO. : 9,124,074 B2
APPLICATION NO. : 14/419680
DATED : September 1, 2015
INVENTOR(S) : Kuki et al.

It is certified that error appears in the above-identified patent and that said Letters Patent is hereby corrected as shown below:

Title Page, Item (30) "Foreign Application Priority Data" is missing, and should include --August 21, 2012 (JP)..... 2012-181963--.

Signed and Sealed this
Ninth Day of February, 2016

Michelle K. Lee

Michelle K. Lee
*Director of the United States Patent and Trademark Office*